US005083329A

United States Patent [19]

Murakami

[11] Patent Number: 5,083,329

[45] Date of Patent: Jan. 28, 1992

[54] APPARATUS FOR EFFECTING MASSAGE WITH WATER STREAM

[76] Inventor: Eiichi Murakami, 36-8, Sendagi 3-chome, Bunkyo-ku, Tokyo, Japan

[21] Appl. No.: 607,397

[22] Filed: Oct. 31, 1990

[30] Foreign Application Priority Data

Mar. 8, 1990 [JP] Japan ..... 2-23527[U]

[51] Int. Cl.[5] ..... A61H 33/02; E03C 1/02

[52] U.S. Cl. ..... 4/543; 4/544; 4/541

[58] Field of Search ..... 4/542, 543, 541

[56] References Cited

U.S. PATENT DOCUMENTS

| | | | |
|---|---|---|---|
| 1,896,938 | 2/1933 | Borowsky | 4/543 |
| 2,856,611 | 10/1958 | Velonis | 4/543 |
| 4,853,987 | 8/1989 | Jaworski | 4/542 |
| 4,903,352 | 2/1990 | Murakami | 4/541 |

FOREIGN PATENT DOCUMENTS

| | | | |
|---|---|---|---|
| 1965252 | 7/1971 | Fed. Rep. of Germany | 4/542 |

*Primary Examiner*—Daniel M. Yasich

*Attorney, Agent, or Firm*—Varndell Legal Group

[57] ABSTRACT

A water massaging apparatus including an inner tub is arranged an outer tub to form upper and lower spaces and first and second side spaces. The side walls of the inner tub have a number of holes. A propeller is arranged in the first side space for providing a water stream which respectively circulates through the first side space, upper space, second side space and lower space. An air pump is arranged outside the outer tube, and one end of a pipe is connected to the air pump and the other end of the pipe is exposed underneath a bottom wall of the inner tube to form an air stream which flows underneath the bottom wall of inner tub in the same direction as that of the water stream. The presence of the air stream underneath the bottom wall of inner tub significantly reduces resistance against the water stream flowing through the lower space.

11 Claims, 5 Drawing Sheets

APPARATUS FOR EFFECTING MASSAGE WITH WATER STREAM

BACKGROUND OF THE INVENTION

The present invention relates to water stream massaging apparatus comprising a tub for holding water, and means for generating a water stream circulated by force within the tub.

Massaging apparatuses have been proposed where a water stream is generated within a tub and projected against a bather in the tub. However, the known massaging apparatus is very complicated in construction and large in size and requires a conduit having a rather large diameter. The speed of the water stream generated in the known apparatus is high, occasionally higher than 2.5 m/s. However, its velocity distribution is uniform, so that a sufficient massaging effect can not be attained within a short time period.

Japanese Patent Application Laid-open Publication Kokai Hei 1-201258 describes a known massaging apparatus which has a small construction and in which the velocity distribution of the water stream can be varied over time. However, this known massaging apparatus has a serious drawback because its construction results in a large resistance against the water stream. Accordingly, this apparatus requires a water pump motor having high power.

SUMMARY OF THE INVENTION

An object of the present invention is to provide a novel and useful apparatus for more effective massaging with a water stream, where the resistance against the water stream is reduced and a water pump motor of a small size can be used.

The present invention is directed to a massaging with a more efficient water stream handling which comprises:

a tube means having an inner space for containing water;

a partitioning means for controlling water flow which includes a partition plate or member for dividing the inner space of tub means into an upper space and a lower space, where the upper and lower spaces communicate with each other through first and second openings respectively provided at opposing ends of the partition plate, and the area above the partition plate can receive a user;

a water stream generating means for generating a water stream which is circulated within the tub through the lower space, the first opening, the space and the second opening; and an air layer producing means for producing an air layer under the partition plate.

In the massaging apparatus according to the invention, the air layer producing means forms an air stream underneath the partition plate, so that the water stream can flow through the lower space with a minimum amount of resistance. This allows for the use of a small and inexpensive water pump for generating the water stream. This also enables circulation of the water stream within the tub means at a higher speed.

In a preferred embodiment of the massaging apparatus according to the invention, the upper and lower spaces are formed by an inner tub which is inserted into the tub means such that a bottom wall of the inner tub is separated from a bottom wall of the tub means and the lower space is formed therebetween. In this embodiment the inner space of the inner tub forms the upper space of the tub means. Openings, such as holes, are provided on opposing end walls of the inner tub for enabling circulation of the water stream. Further, an air layer producing means is arranged underneath the bottom wall of the inner tub, which includes an air pump for providing a stream of air in the same direction of flow as that of the water stream.

In another preferable embodiment of the massaging apparatus according to the invention, the partitioning means comprises a sheet-like partition plate which is inserted into the tub means and which divides the inner space of the tub means into the upper and lower spaces. An air pump is provided underneath the partition plate for providing an air stream in the same direction of flow as that of the water stream.

DESCRIPTION OF THE PREFERRED EMBODIMENTS

Figure 1:
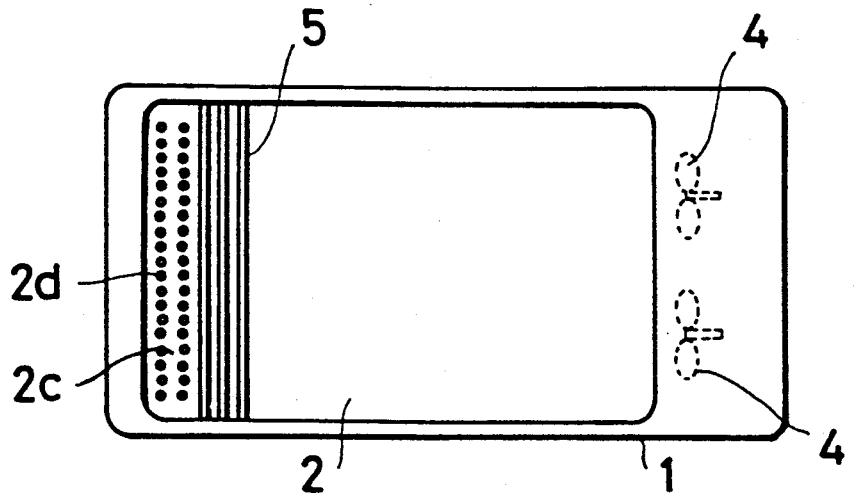
FIG. 1 is a plan view showing a first embodiment of the massaging apparatus according to the invention.
Figure 2:
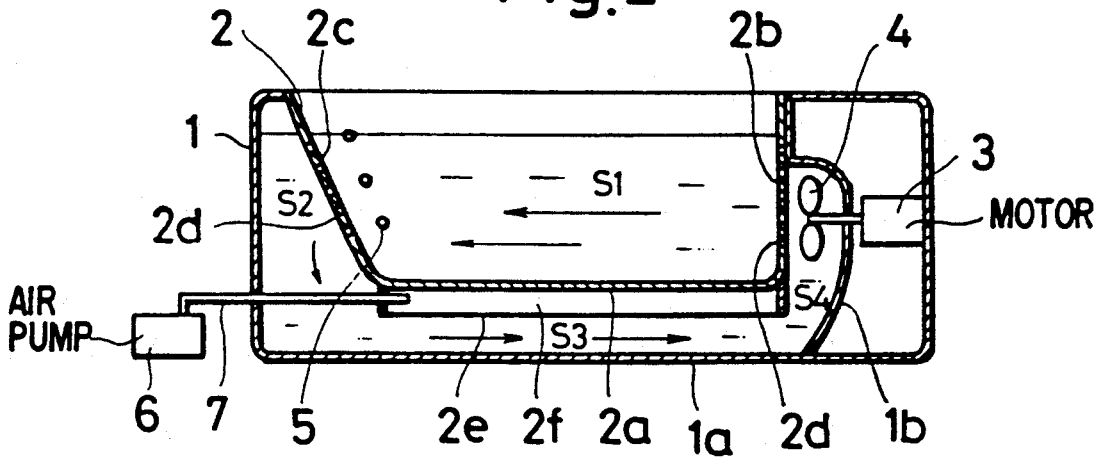
FIG. 2 is a longitudinal cross sectional view of the apparatus shown in FIG. 1.
Figure 3:
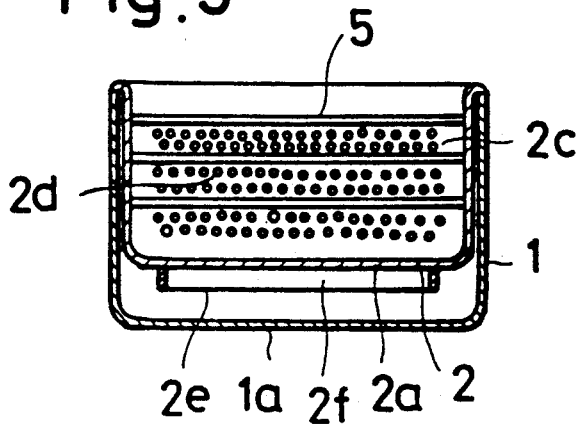
FIG. 3 is a lateral cross sectional view of the apparatus illustrated in FIG. 1.
Figure 4:
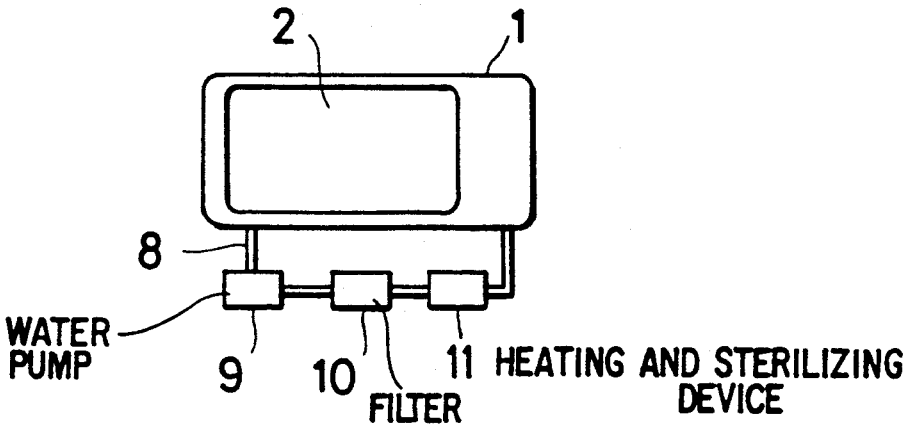
FIG. 4 is a schematic plan view depicting the whole construction of the apparatus of the first embodiment.

FIGS. 1 to 4 show a first embodiment to the massaging apparatus according to the invention. In these figures, reference numeral 1 denotes an outer tub made of a hard synthetic resin. A partitioning means is arranged within the outer tub in the form of an inner tub 2 made of the same material as that of the outer tub 1. The inner tub 2 constitutes an upper space S1. The inner tub 2 is inserted in the outer tub 1 such that the side walls **2*b*, 2*c* and the bottom wall 2*a* of inner tub 2 are separated from the side walls and bottom wall 1*a* of outer tub 1, so as to form side spaces S2, S4 and lower space S3. In this embodiment, the bottom wall 2*a* of inner tub 2 functions as a partition plate separating the upper space S1 and lower space S3. The inner tub 2 has a shape and dimension suitable for comfortably accommodating a user. In the present embodiment, the inner tub 2 has a rectangular shape. In each of the opposing side walls 2*b* and 2*c* of inner tub 2, a number of holes 2*d*** are provided. Frame like side plates 2e are secured on the lower surface of the bottom wall 2a which together with the bottom wall 2a form a space 2f underneath the bottom wall 2a. As shown in FIG. 2, a motor 3 can be arranged in the right hand portion of the outer tub 1 between the tub and side wall 1b. A propeller 4 is arranged behind side wall 2b of inner tub 2 and is connected to the motor 3. The motor 3 and propeller 4 constitute a water stream generating means for generating a water stream which is forcedly circulated from the side space S4 through the upper space S1 formed by the inner tub 2, the side space S2, and the lower space S3 formed between the bottom walls 1a and 2a of the outer and inner tubs 1 and 2, respectively, via the holes 2d formed in the side walls 2b and 2c of inner tub 2 as shown by arrows. In order to prevent the user from being drawn into the holes 2d in the side wall 2c of inner tub 2, a protection frame 5 is provided in front of the side wall 2c of inner tub 2. It should be noted that the total cross sectional area of the holes 2d in the side wall 2b is substantially equal to that of the holes 2d in the side wall 2c and substantially equal to the cross sectional area of the passageway for the water stream formed between the outer and inner tubs 1 and 2 in the lower space S3. An air pump 6 is arranged outside of outer tub 1 which communicates via a tube 7 with the space 2f formed underneath the bottom wall 2a of inner tub 2. As illustrated in FIG. 4, a bypass tube 8 which feeds water pump 9, a filter 10 and a heating and sterilizing device 11 are also provided on the outer tub 1.

During operation of the apparatus of the present invention, the outer and inner tubs 1 and 2 are filled with water to a suitable level and the user enters the water. When motor 3 is energized, it generates the water stream which circulates through the spaces S1 to S4. At the same time, the air pump 6 is energized to supply air within the space 2f formed underneath the bottom wall 2a of inner tub 2. With this arrangement, the water stream flows underneath the air layer formed in the space 2f and the resistance to the flow of the water stream becomes very low. A portion of the air introduced into the space 2f can flow away together with the water stream. Accordingly, the air pump 6 can be continuously or intermittently energized in such manner that the air layer is always present within the space 2f. When a large amount of the air is supplied into the space 2f, a large amount of air bubbles are generated, and these air bubbles are intermixed with the water stream. The resulting mixture permits the air bubbles to be projected against the user's body which promotes generation of heat.

A portion of the water fan be drawn into the bypass tube 8, and any debris contained therein are filtered out by means of the filter 10. Thereafter, the water is sterilized and heated by the heating and sterilizing device 11. In this manner the temperature of the water can be controlled.

Figure 5:
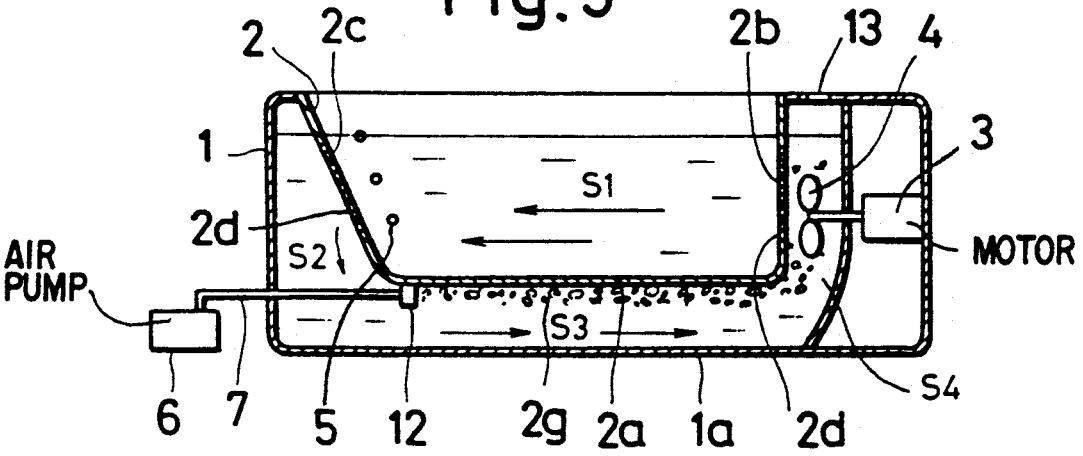
FIG. 5 is a longitudinal cross sectional view showing a second embodiment of the massaging apparatus according to the invention.
Figure 6:
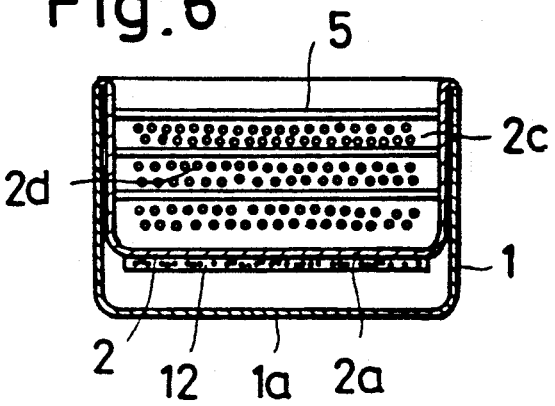
FIG. 6 is a lateral cross sectional view of the apparatus shown in FIG. 5.
Figure 7:
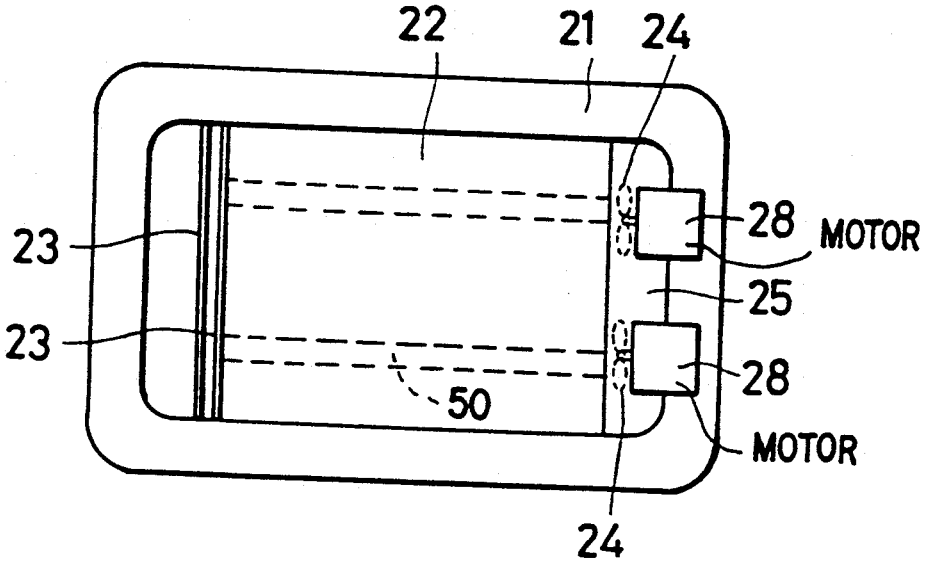
FIG. 7 is a plan view illustrating a third embodiment of the massaging apparatus according to the invention.
Figure 8:
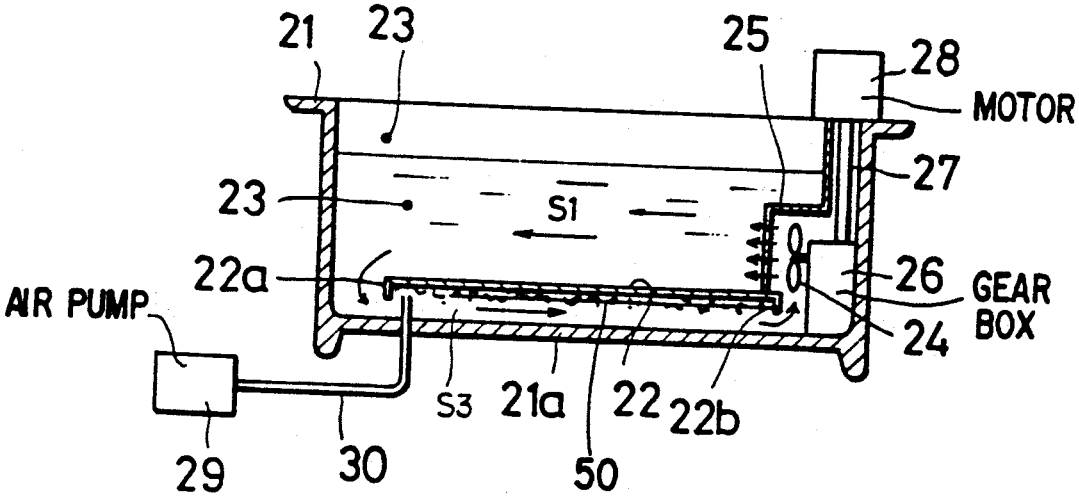
FIG. 8 is a longitudinal cross sectional view of the apparatus depicted in FIG. 7.
Figure 9:
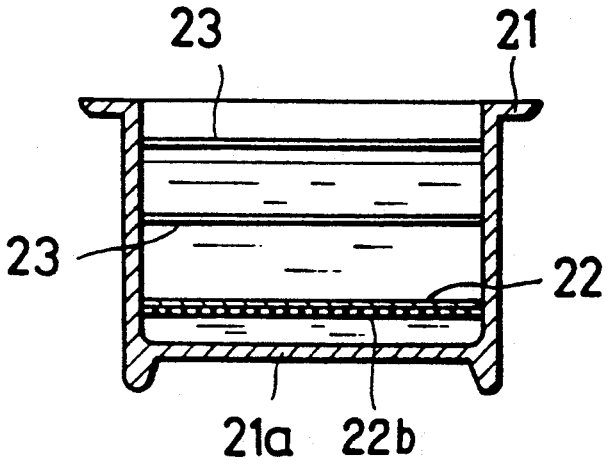
FIG. 9 is a lateral cross sectional view of the massaging apparatus according to the invention.

FIGS. 5 and 6 illustrate another embodiment of the massaging apparatus according to the invention. In this embodiment, side plates 2e are needed. In this embodiment, air stream 2g is formed by ejecting air from a nozzle 12. As illustrated in FIG. 6, the nozzle 12 has a length which is substantially equal to the width of the bottom of inner tub 2 and comprises a number of small holes. The nozzle 12 is connected to the air pump 6 by means of the pipe 7. When the air pump 6 is turned on, a large number of air bubbles are produced from the nozzle 12 and these air bubbles flow under the bottom wall 2a of inner tub 2, and the air stream mixes together with the water stream. The air bubbles can escape from the space S4 by means of a hole 13. The air layer is also present underneath the bottom wall 2a of inner tub 2 in this embodiment, so that the water stream can flow through the space S3 with minimal resistance.

In the embodiment so far explained, only one propeller 4 is necessary, but according to the invention, a second propeller can be arranged in the space S2 adjacent the side wall 2c of inner tub 2 such that a very sophisticated and/or stronger water stream can be generated by controlling the rotation speeds of the propellers.

Figure 10:
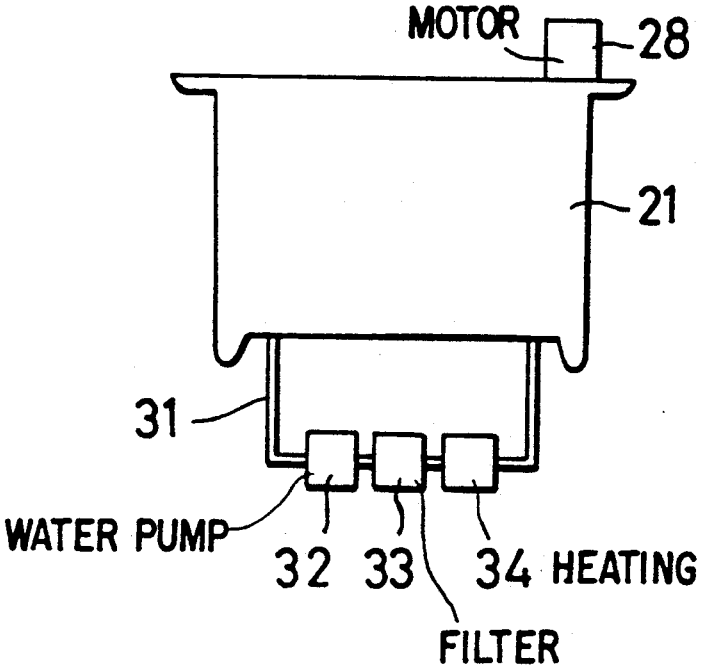
FIG. 10 is a schematic side view showing the whole construction of the apparatus shown in FIGS. 8 and 9.

FIGS. 7 to 11 show a third embodiment of a massaging apparatus according to the invention. In this embodiment an inner space of a tub 21 is divided into upper and lower spaces S1 and S3 by means of a partition plate 22 which has a flat sheet-like structure arranged in parallel with the bottom wall 21a of a tub 21. The partition plate 21 has sufficient strength so that a user can stand or sit thereon. Side plates 22a and 22b are secured on the lower surface of the partition plate at opposite ends thereof. Within the space S1 of the tub 21 a protection frame 23 is provided for preventing the user from closing the water passageway between the upper and lower spaces S1 and S3. Two propellers 24 are arranged on the right hand side of the tub 21 which are covered by a mesh plate 25. The propellers 24 are coupled with motors 28 by means of a gear box 26 and shaft 27. The motors 28 are arranged on the upper edge of tub 21. An air pump 29 is provided outside of tub 21 which is connected to a pipe 30 whose free end is positioned under the partition plate 22. As illustrated in FIG. 10, the inner space of the tub 21 is connected to a bypass tube 31 in which water pump 32, filter 33, and heating and sterilizing device 34 are arranged.

In the present embodiment, when the air pump 29 is energized, air is supplied under the partition plate 22, so that the water stream can be circulated through the spaces S1 and S3 with minimal resistance. It should be noted that the partition plate 22 can have one or more holes formed therein so that a sophisticated water stream can be generated. Further, it is advantageous to provide reinforcing ribs 50 on the lower surface of the partition plate 22. In this case the reinforcing ribs are arranged in the air layer, so that the ribs do not provide any resistance against flow of the water stream.

Figure 11:
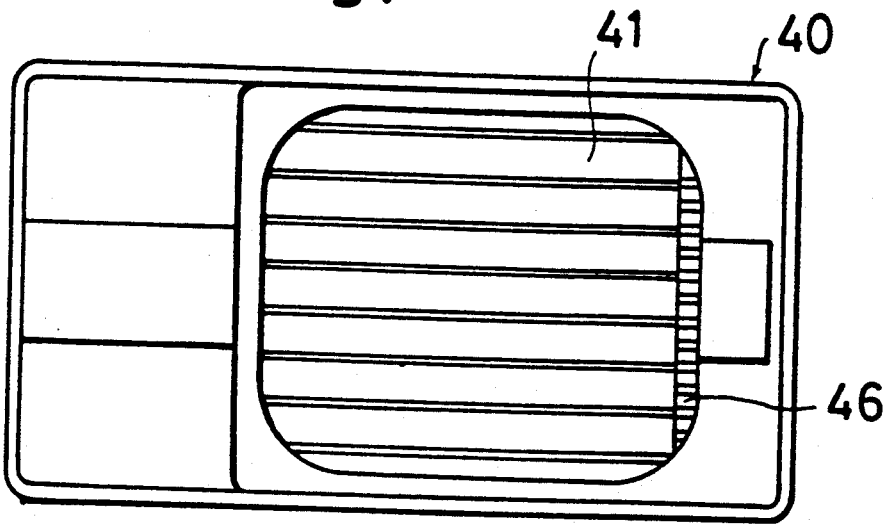
FIG. 11 is a plan view representing a fourth embodiment of the massaging apparatus according to the invention.
Figure 12:
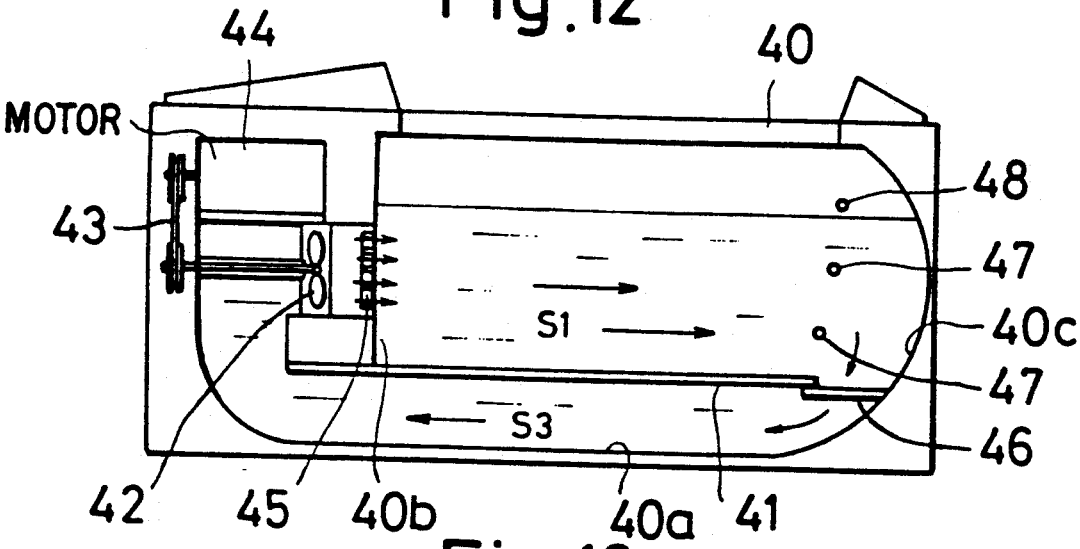
FIG. 12 is a longitudinal cross sectional view of the apparatus depicted in FIG. 11.
Figure 13:
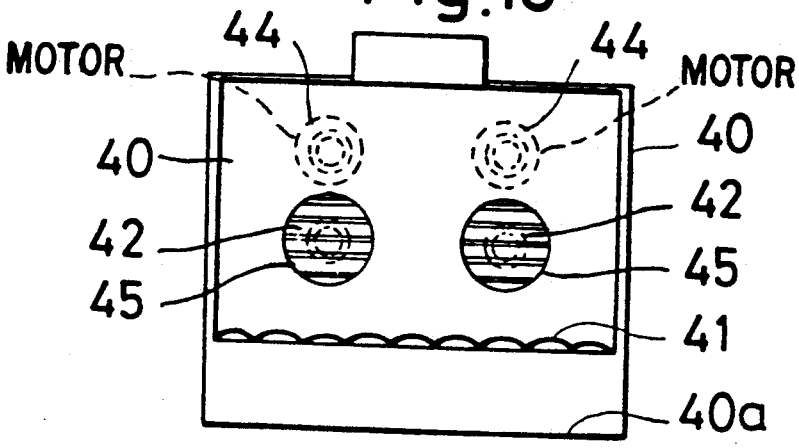
FIG. 13 is a lateral cross sectional view of the massaging apparatus illustrated in FIG. 11.

FIGS. 11 to 13 depict a fifth embodiment of a massaging apparatus according to the invention. A tub 40, made of stainless steel, has an inner space divided by a partition plate 41, also made of stainless steel. The partition plate 41 is a flat sheet-like plate and arranged in parallel with the bottom wall 40a of tub 40. The lower surface of partition plate 41 has a wavy or undulated configuration as shown in FIG. 13, so that the water stream can easily flow underneath the partition plate 41. Two propellers 42 are provided which are driven by motors 44 by means of a belt 43. A side wall 40b includes circular openings 45 adjacent the propellers 42, so that the water stream is ejected from the circular openings 45. A side wall 40c arranged to face side wall 40b near the end of tub 40 has a curved surface, so that the water stream is guided toward a grid member 46. A frame plate (not shown) can be secured to the lower surface of partition plate 41 to form a space within which the air layer is retained in a similar manner to that of the first embodiment.

In the present embodiment, no air pump is necessary for supplying the air into the space underneath the partition plate 41. If the water contains air bubbles, the bubbles are retained in the space under the partition plate 41, so that the air layer is produced in the space. In order to produce the air bubbles, it is possible eject air into the water or add a small amount of a surface active agent to the water. The air bubbles thus produced are retained in the space underneath the partition plate 41, and therefore resistance against the flow of the water stream underneath the partition plate can be reduced.

As explained above in detail, according to the present invention, an air layer is produced underneath a partitioning means which divides the space within the tub means into the upper and lower spaces. With this arrangement, a water stream can be circulated smoothly with minimal resistance underneath the partitioning means. Therefore, the water stream can flow within the tub means at a higher speed, and the water pump necessary for generating the water stream can be small and less expensive. Moreover, the massaging apparatus according to the invention can be easily manufactured by reconstructing existing bath tubs.

What is claimed is:

1. A massaging apparatus having improved water stream handling which comprises:

tub means having an inner space for holding water;

partitioning means for controlling water flow within said tub means, said partitioning means including a partition plate dividing said inner space into upper and lower spaces and having a surface for receiving a bather, and first and second openings respectively arranged at opposing sides of said partition plate for fluidly connecting said upper and lower spaces;

water stream generating means for generating a water stream circulated within said tub means through said lower space, said first opening, said upper space and said second opening; and air layer producing means for providing an air layer under said partition plate.

2. An apparatus according to claim 1, wherein said air layer producing means comprises an air pump arranged outside said tub means, a pipe having one end connected to said air pump and another end opening underneath said partition plate, for providing a air stream which flows underneath said partition plate in the same direction as that of said water stream.

3. An apparatus according to claim 2, wherein said air layer producing means includes side plates secured to a lower surface of said partition plate for forming an air retaining space therewith.

4. An apparatus according to claim 1, wherein said water stream generating means comprises at least one propeller driven by a motor, said propeller arranged within said inner space of said tub means.

5. An apparatus according to claim 4, wherein a water-free space is provided within said inner space of said tube means, and said propeller is arranged in said water-free space.

6. An apparatus according to claim 4, wherein said motor for driving said propeller is arranged on an upper edge of said tub means and said water stream generating means further comprises a means for transmitting rotational force of said to said propeller.

7. An apparatus according to claim 1, wherein said partitioning means comprises an inner tub inserted in said tub means where said partition plate comprises a bottom wall of said inner tub, and said first and second openings include a number of holes provided on opposing side walls of said inner tub.

8. An apparatus according to claim 1, wherein said partition plate includes a sheet-like member arranged within said inner space of tub means so that a bottom of said partition plate is parallel to a bottom wall of said tub means.

9. An apparatus according to claim 1, further comprising a protection member arranged within said upper space in front of said second opening for inhibiting objects other than water from entering said second opening.

10. An apparatus according to claim 1, wherein said air layer producing means includes a nozzle for injecting air and intermixing said air with said water stream for forming air bubbles so that a portion of said air bubbles passes through said first opening.

11. An apparatus according to claim 10, wherein said tub means has an opening at the top thereof for another portion of said air bubbles to exit from said tub means.

* * * * *